US006513202B2

(12) United States Patent
Zimmermann

(10) Patent No.: US 6,513,202 B2
(45) Date of Patent: Feb. 4, 2003

(54) CLOSING DEVICE, SPECIFICALLY FOR CLOSING A BAG

(75) Inventor: Arnold Zimmermann, Colombier (CH)

(73) Assignee: Zim-Clip G.m.b.H., Nuremberg (CH)

( * ) Notice: Subject to any disclaimer, the term of this patent is extended or adjusted under 35 U.S.C. 154(b) by 0 days.

(21) Appl. No.: 09/984,813

(22) Filed: Oct. 31, 2001

(65) Prior Publication Data

US 2002/0062538 A1 May 30, 2002

(30) Foreign Application Priority Data

Nov. 25, 2000 (EP) ..... 00125865

(51) Int. Cl.[7] ..... B65D 33/28; B65D 63/00

(52) U.S. Cl. ..... 24/30.5 R; 24/16 PB; 24/17 AP; 24/17 B; 24/30.5 P

(58) Field of Search ..... 24/30.5 R, 30.5 P, 24/116 PB, 17 AP, 17 B; 292/318; 206/338

(56) References Cited

U.S. PATENT DOCUMENTS 3,255,501 A * 6/1966 Laguerre ..... 24/16 PB
4,001,919 A * 1/1977 Moberg et al. ..... 24/16 PB
4,174,554 A * 11/1979 Flantua ..... 24/30.5 R
4,403,375 A * 9/1983 Blum ..... 24/16 PB
4,501,354 A * 2/1985 Hoffman ..... 24/16 PB
5,893,456 A * 4/1999 Bosmans ..... 24/17 AP

FOREIGN PATENT DOCUMENTS

| | | |
|---|---|---|
| DE | 44 18 877 | 12/1996 |
| GB | 2 026 078 | 1/1980 |
| GB | 2 290 518 | 1/1996 |
| NL | 0 113 068 | 7/1966 |

* cited by examiner

*Primary Examiner*—Victor Sakran
(74) *Attorney, Agent, or Firm*—Kenyon & Kenyon

(57) ABSTRACT

The closing device for a closing and a repeated closing of a bag consists of a strap which is bent to form a loop by a permanent connection. The strap has an inner portion and an outer portion. The inner portion and the outer portion are connected to each other by a design rupture line and a permanent connection. The strap may be opened by partial serving of the inner portion from the outer portion and by folding out the inner portion so that an opening is produced in the outer portion. In order to close the strap again, the inner portion is inserted into the opening in the outer portion.

20 Claims, 4 Drawing Sheets

21
21

15
10
6
26
4
2
1
17
124 10 00
3
5
9
VIII
VIII
B
15
11
18
19
19
18
24
7
8

12
17
124 10 00
15
13
13
14
14
2
16
1
15

CLOSING DEVICE, SPECIFICALLY FOR CLOSING A BAG

CROSS REFERENCE TO A RELATED APPLICATION

This application is based on the European Patent Application No. 00 125 865.6-2308, filed Nov. 25, 2000, of which the priority is claimed.

BACKGROUND OF THE INVENTION

The present invention relates to a closing device, specifically for a closing of a bag, which closing device has a strap adapted to enclose a bag, which strap is bent to a loop which is closed by a permanent connection.

DESCRIPTION OF THE RELATED ART

Such a closing device is disclosed e.g. in the German Publication DE 44 18 877 C2. This closing device, after having been opened, can not be readily closed again and an initial opening thereof is difficult to recognize.

SUMMARY OF THE INVENTION

Hence, it is a general object of the invention to provide a closing device, specifically for a closing of a bag which enables a better recognition of an initial opening thereof and may easily be closed again.

A further object is to provide a strap of the kind set forth above and comprising an inner portion and an outer portion, which portions are defined against each other by a design rupture line and connected through mentioned permanent connection enabling an opening of the loop by a severing of the design rupture line and a folding of the inner portion out of the outer portion, which inner portion is adapted to be inserted into an opening produced in the outer portion for a producing of a releasable connection between the inner portion and the outer portion.

The strap includes preferably in the folded out state of the inner portion a tongue formed at least in part by the inner portion which tongue is adapted to be inserted into the opening of the outer portion. According to a preferred embodiment this tongue has preferably recesses and/or projections for a form-locked anchoring in the opening of the outer portion. Form locked is to be understood that such an anchoring can be overcome and opened upon excertion of a pulling force only by a deformation of the inner and/or outer portion. Mentioned recesses are preferably formed at least in part by the inner and/or outer portion.

If, according to a further preferred embodiment, the inner portion projects beyond an end of the strap when it is in the folded out state, the strap may be accordingly lengthened and its manipulation will be facilitated.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE PREFERRED EMBODIMENTS

Figures 1, 2, 3, 8:
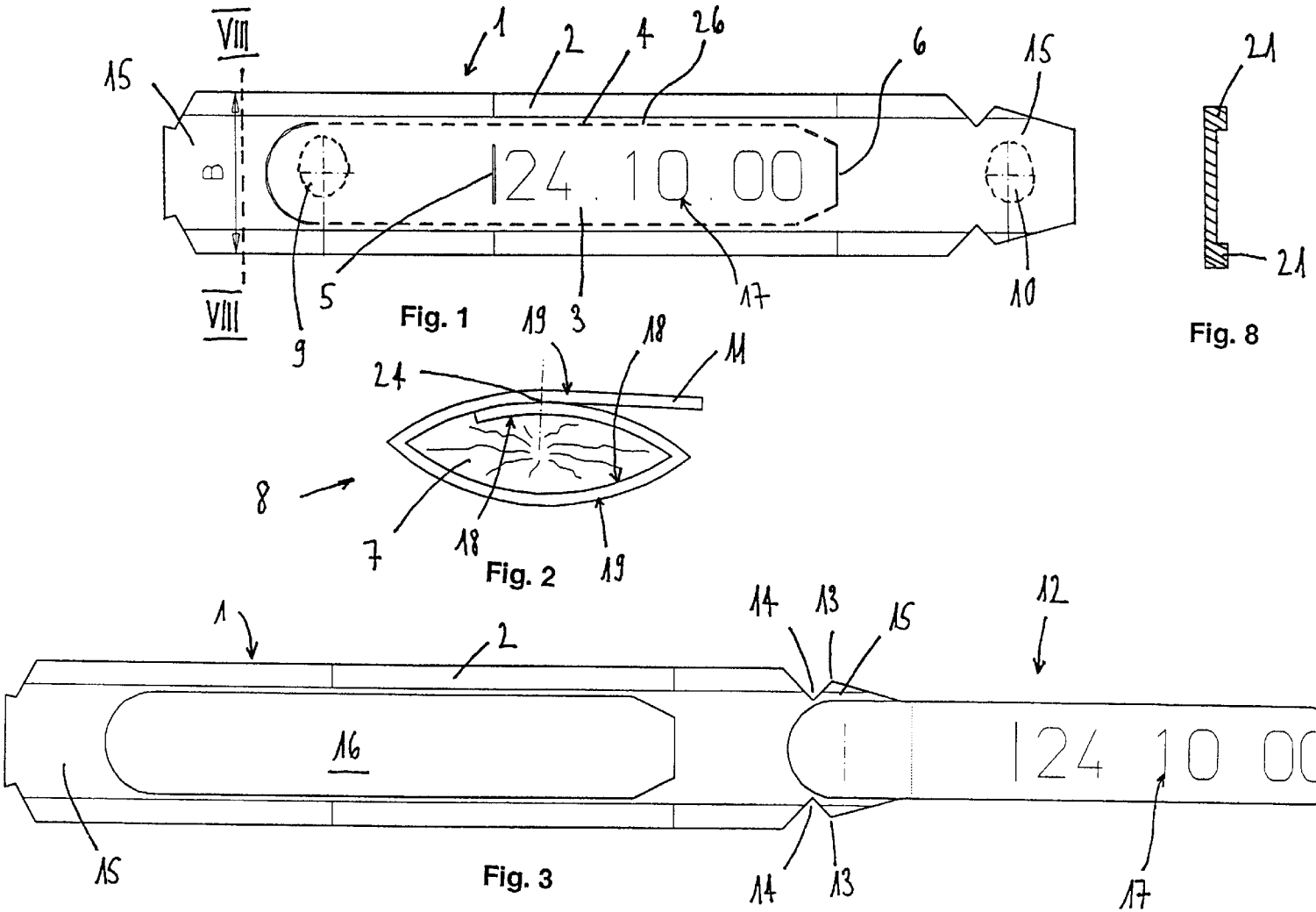
FIG. 1 is a view of a closing device structured in accordance with the invention prior to its placing onto a bag.
FIG. 2 is a top view of the closing device of FIG. 1 in a closed state applied around a bag.
FIG. 3 illustrates the closing device of FIG. 2 in its opened state.
FIG. 8 is a cross-section of the closing device along line VIII—VIII of FIG. 1 with lengthwise extending ribs.

FIG. 1 illustrates a closing device in the state prior to its placing onto a bag to be closed. The closing device consists generally of a flexible strap 1 made of a plastic material, which strap 1 has a width in the range of for instance 5–10 millimeters and a thickness less than for instance 1 millimeter. The strap 1 consists of an outer portion 2 and an inner portion 3. The outer portion 2 is defined against the inner portion 3 by a design rupture line 4. The design rupture line 4 can be performed for instance as a perforation, through which the inner portion 3 is connected to the outer portion 2 by a plurality of webs 26. The inner portion 3 can be severed from the outer portion 2 along the rupture line 4 and then be folded back.

The strap 1 includes two design bending lines 5 and 6. These design bending lines 5 and 6 are to enable the strap 1 to be bent at the location of these lines 5 and 6 more easily than at the locations having no design bending lines. In the embodiment according to FIG. 1, one of the design bending lines is formed by a lateral slot in the inner portion 3. The second design bending line is formed by a contiguous portion of the design rupture line 4 extending perpendicularly to the strap 1.

When placing the strap 1 onto a bag it is folded around the design bending lines 5 and 6 into a U-shaped state and then placed over a bag 7. Thereafter, the strap 1 is formed into a loop 8 in a manner as illustrated in FIG. 2. This is followed by a joining of the outer portion 2 and the inner portion 3 at the connection areas 9, 10 to a permanent connection 24, so that the strap 1 forms a closed loop 8. This permanent connection 24 can be achieved by a permanent adhesively bonded and/or welded connection or as a mechanical form locked connection which can be opened with difficulties only. The respective connection areas 9, 10 are illustrated in FIG. 1 by broken lines. These connection areas 9, 10 are preferably located at the ends 15 of the strap 1.

When pulling at one end 11 of the strap 1 illustrated in FIG. 2 for the initial opening of the closing device, the inner portion 3 is severed from the outer portion 2 along the design rupture line 4. This leads to a opened closing device as illustrated in FIG. 3. The inner portion 3 and the outer portion 2 are now merely interconnected by the permanent connection 24. The inner portion 3 forms now together with one of the ends 15 of the outer portion a tongue 12 which renders the strap 1 to be longer. Two projections 13 and two recesses 14 are formed at the basis of the tongue 12, which projections 13 and recesses 14 are formed by one of the ends 15 of the outer portion 2.

In order to again close an opened closing device, the tongue 12 can be inserted into the opening 16 of the outer portion 2 which has been produced by the folding back of the inner portion 3, so that the projections 13 and recesses 14 hook into the outer portion 2 wherewith a form locked, releasable connection is arrived at.

When pulling unintentionally at the end 11 of the closing device according to FIG. 2, some first webs 26 of the design rupture line 4 will be ruptured at the best, thus the closing device remains basically intact. Therefore, due to the plurality of webs 26 along the elongate inner portion 3 an unintentional lifting up of the inner portion 3 is hardly possible.

A lettering 17 as illustrated in FIGS. 1 and 3, which displays for instance the expiration date of the commodity contained in the bag, is placed on the outer side of the inner portion 3, i.e. at the side facing away from the bag. This location of the lettering 17 allows the lettering 17 to be recognized by the consumer when the closing device is in its initially closed or its once again closed state.

Figure 5:
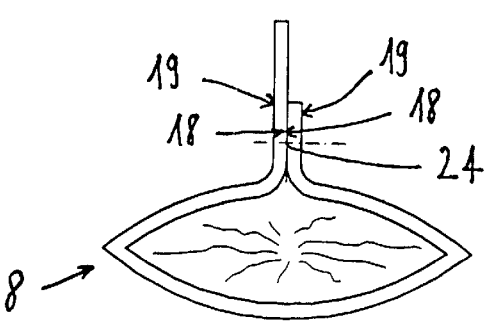
FIG. 5 is a top view of the closing device illustrated in FIG. 1 placed closed around a bag in accordance with a third embodiment.
Figure 4:
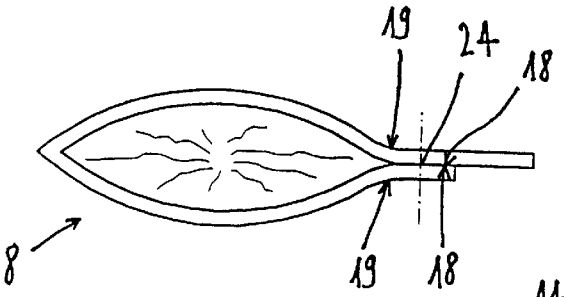
FIG. 4 is a top view of the closing device illustrated in FIG. 1 in accordance with a second variant of the state closed around the bag.

At the embodiment of the closing device illustrated in FIG. 2, the inner side 18 of the strap 1 rests at the point of the permanent connection 24 on the outer side 19, which makes the inner portion 3 after the lifting out of the inner portion 3 to form in its stretched state the tongue 12. Alternative embodiments to FIG. 2 are illustrated in FIGS. 4 and 5. It can be seen that according to these Figures two areas of the inner side 18 lie on top of each other. This arrangement has the advantage that the outer portion 2 and the inner portion 3 can be welded together quite easily in order to form the permanent connection 24. Contrary to the embodiment of FIG. 2, in which the inner portion 3 when folded back out of the outer portion 2 is present as tongue 12 in a stretched out state, the inner portion 3 projects at the embodiment according to FIGS. 4 and 5 after it has been severed towards the opening 16 and must be bent in order to form the tongue 12.

Figure 6:
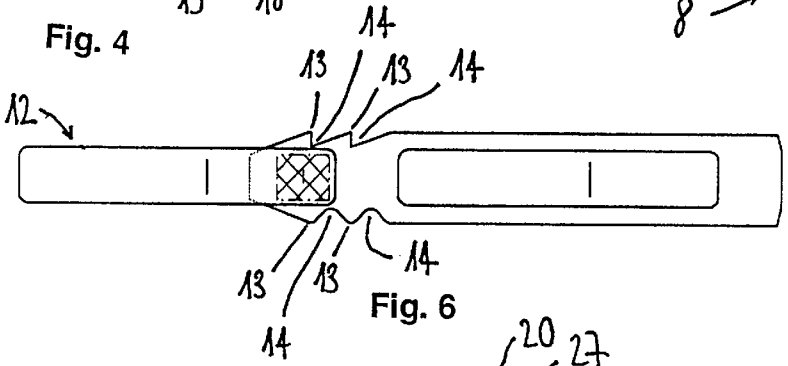
FIG. 6 illustrates a second embodiment of the closing device in an opened state.

At the embodiment according to FIG. 3, two projections 13 and two recesses 14 are formed at the base of the tongue 12. Two further embodiments of projections and recesses 13, 14 are illustrated in FIG. 6. FIG. 6 illustrates at the basis of the tongue 12 at either side two projections and recesses 13, 14, whereby at one of the sides the projections and recesses 13, 14 have sharp corner areas. The projections and recesses 13, 14 at the opposite side are illustrated as alternative having rounded corner areas. These two embodiments are insofar advantageous in that bags of various sizes can be closed. Additionally, repeatedly closing devices of this design can be closed and locked more securely in comparison with the embodiment according to FIG. 3.

Figure 7:
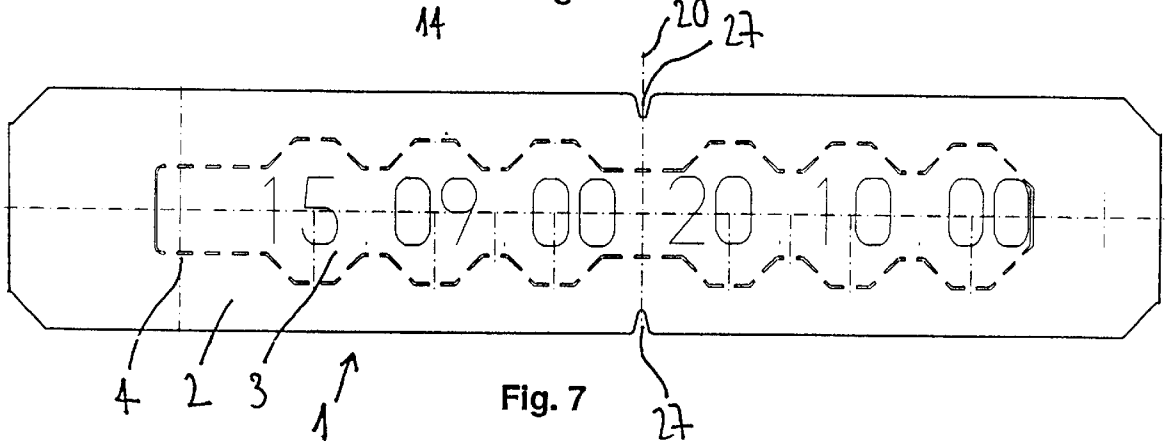
FIG. 7 illustrates a second embodiment of the closing device prior to its placing onto a bag.

FIG. 7 illustrates, analogue to FIG. 1, a strap 1 having an outer portion 2 and an inner portion 3, which two portions 2 and 3 are defined against or separated from, respectively, each other by a design rupture line 4. Contrary to FIG. 1 or FIG. 6 the projections and recesses 14 are located at the inner portion 3. A design bending line 20 formed by recesses 27 is located, contrary to the embodiment illustrated in FIG. 1, in the outer portion 2. Again, an opening 16 can be produced upon lifting the inner portion 3 out of the outer portion 2 through which opening 16 the inner portion can be inserted into the outer portion 2 in order to form a releasable connection between these two portions 2, 3.

FIG. 8 illustrates the cross-section through a closing device according to FIG. 1. This closing device includes in its outer portion 2 longitudinally extending projecting ribs 21. Contrary to a closing device without any ribs, a closing device with ribs 21 has the advantage that it is less deformable by the bag in its initially closed or again closed state, so that the closing device closed the bag off in an improved manner.

Figure 9:
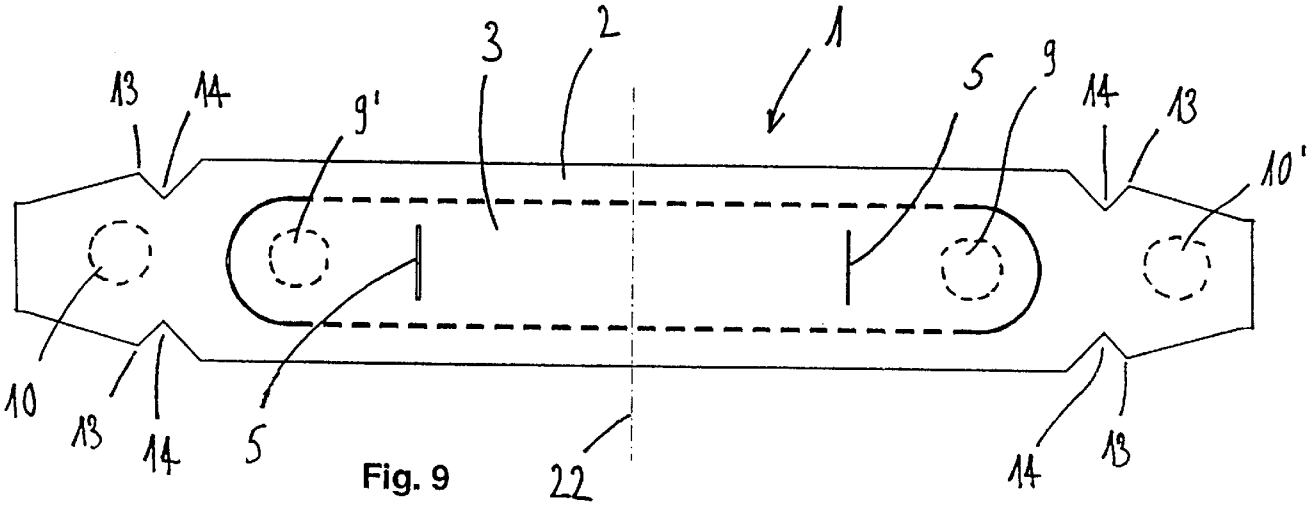
FIG. 9 illustrates a third embodiment of the closing device prior to its placing onto a bag.

FIG. 9 illustrates, analogue to FIG. 1, a further embodiment of the closing device prior to its placing onto the bag 7 to be closed. Contrary to the embodiment according to FIG. 1, the strap 1 is designed regarding its longitudinal extent symmetrically relative to an axis of symmetry 22. At both sides of this transverse axis of symmetry 22, a design bending line in form of a transverse slot 5 and two projections 13 and two recesses 14, as well, are formed in the strap 1, such as illustrated in FIG. 9. When the strap 1 is placed on the bag, the inner portion 3 and the outer portion 2 are connected to each other analogue to the procedure set forth by reference to FIG. 1, which connection is made at the connection areas 9', 10' or 9, 10 for forming the permanent connection 24. A symmetrically designed closing device has the advantage that the production and placing of the closing device does not depend from a specific design at either side of the closing device.

Figure 10:
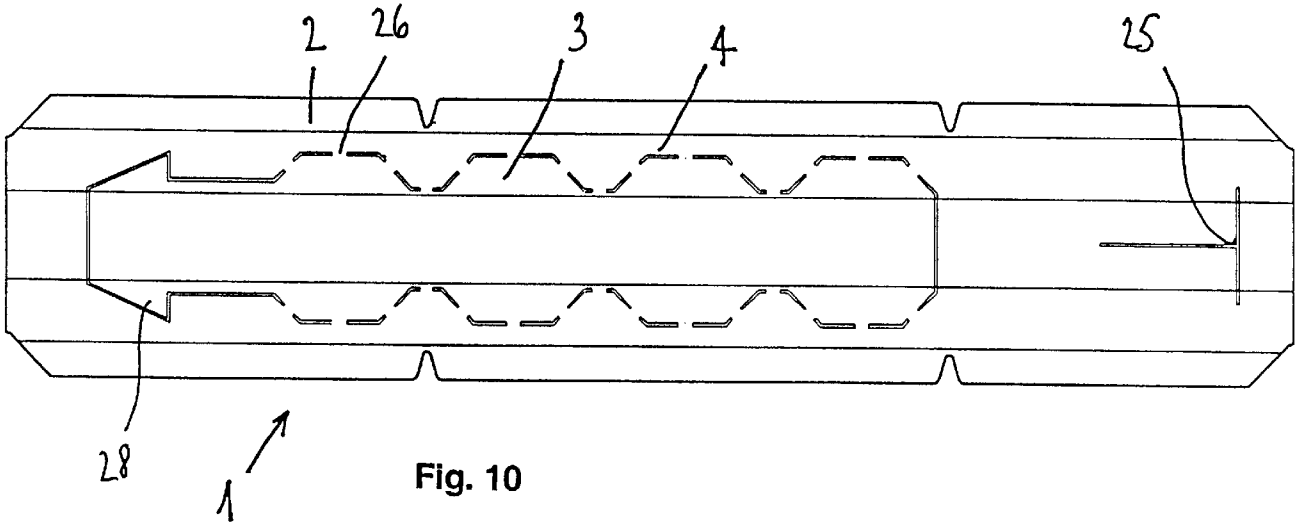
FIG. 10 illustrates a fourth embodiment of the closing device prior to its placing onto a bag.

FIG. 10 illustrates, analogue to FIG. 1, a further embodiment of the closing device prior to its application onto a bag 7. In comparison with the embodiment of the closing device according to FIG. 1, the permanent connection 24 between the inner portion 3 and the outer portion 2 of this closing device is a mechanical, form locked connection. It is formed in that a hook-like shaped portion 28 of the inner portion 3, which is not connected through webs 26 with the rupture line 4 to the outer portion 2, is inserted into the slot 25. When re-opening the closing device, the inner portion 3 is severed from and lifted off the outer portion along the design rupture line 4, whereby the anchoring of the portion 28 in the slot 25, which is difficult to be opened, is not opened, so that the inner portion 3 forms again a tongue 12 rendering the strap 1 longer.

In order to close a closing device of the embodiments described above, which has been opened once, the tongue 12 has to be inserted into the opening 16 produced by a lifting the inner portion 3 out of the outer portion 12. Alternative to this design, a further opening may be foreseen in the outer portion 2 independently from or in association with the opening 16, e.g. in a shape corresponding to the slot 25, through which the tongue 12 can be inserted in order to form the releasable connection.

Figure 11:
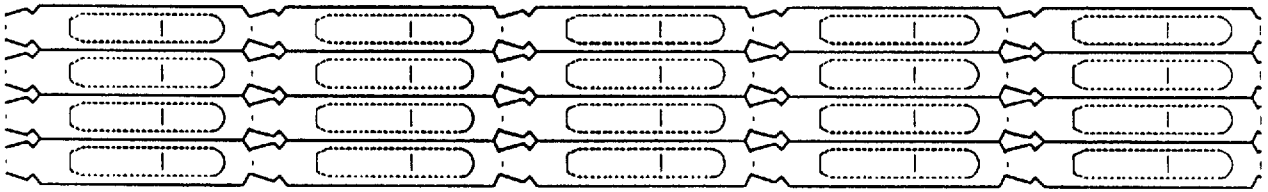
FIG. 11 illustrates closing devices after their production by an extruding process.

The producing is made by a simultaneous producing of a plurality of closing devices as, illustrated in FIG. 11, the producing proceeding by an extrusion followed by a punching or embossing step, whereby the direction of the extruding movement may be oriented perpendicularly or parallel to the longitudinal axes of the closing devices.

Figure 12:
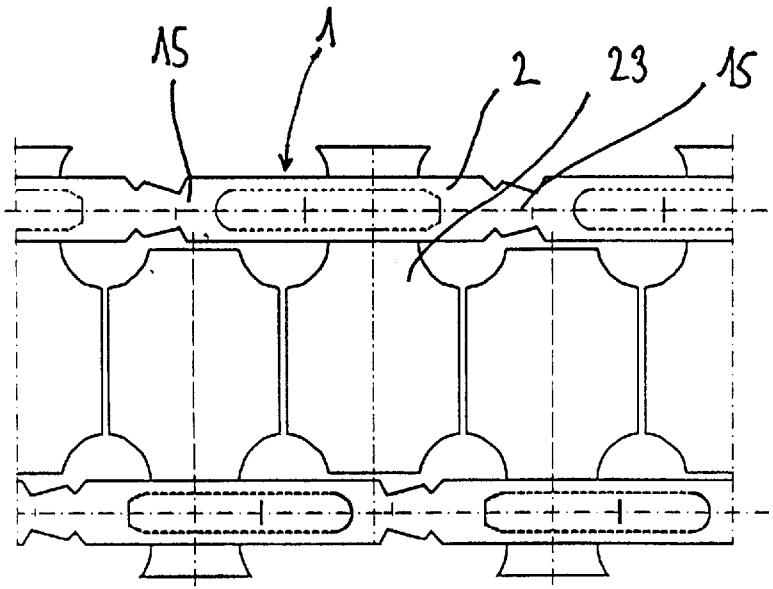
FIG. 12 illustrates closing devices with projections after their production by an extruding.

FIG. 12 illustrates embodiments of closing devices which include additionally domed areas 23 at the outer portion 2. These domed areas 23 can be used as labels, as supports for labels or any kind of ornamentation, lettering, symbols. After the production, the ends 15 of the straps 1 are interconnected to strips, whereby the domed areas 23 of oppositely located straps 1 are arranged alternating relative to each other, so that a maximal use is made of the space between the strips.

While there are shown and described present preferred embodiments of the invention, it is to be distinctly understood that the invention is not limited thereto, but may be otherwise variously embodied and practiced within the scope of the claims.

What is claimed is:

1. A closing device, specifically for a closing of a bag, which closing device has a strap adapted to enclose a bag, which strap is bent to a closed loop which is closed by a permanent connection, said strap comprising an inner portion and an outer portion, which portions are defined against each other by a design rupture line and are connected through said permanent connection enabling an opening of said loop by a severing of said design rupture line and a folding of said inner portion out of said outer portion, which inner portion is adapted to be inserted into an opening produced in said outer portion for a producing of a releasable connection between said inner portion and said outer portion.

2. The closing device of claim 1, wherein said strap comprises in the folded out state of said inner portion a tongue formed at least in part by said inner portion, said tongue adapted to be inserted into said opening of the outer portion, which tongue comprises recesses and/or projections for a form-locked locking of the tongue in said opening of the outer portion.

3. The closing device of claim 2, wherein said recesses and/or projections are formed at least in part by said inner portion.

4. The closing device of claim 2, wherein said recesses and/or projections are formed at least in part by said outer portion.

5. The closing device of claim 1, wherein said strap comprises an outer side and an inner side and wherein said inner side comprises two connection areas which form, connected together, said permanent connection.

6. The closing device of claim 1, wherein said strap comprises an outer side and an inner side and wherein said inner side comprises a connection area and said outer side comprises a further connection area, which connection areas form, connected to each other, said permanent connection.

7. The closing device of claim 1, wherein said outer portion comprises a projecting area as label or for the receipt of a label.

8. The closing device of claim 1, wherein said strap comprises an outer side and an inner side and wherein a lettering is located on said outer side.

9. The closing device of claim 1, wherein said strap, specifically its outer portion comprises at least one reinforcing rib extending in its longitudinal direction.

10. The closing device of claim 1, wherein said strap comprises at least one transversely extending design bending line, which is located preferably at least in part in the inner portion.

11. The closing device of claim 10, wherein said design bending line is designed as a slot and/or specifically as a portion of said design rupture line.

12. The closing device of claim 1, wherein said permanent connection is a welded connection between connecting areas of said strap.

13. The closing device of claim 1, wherein said permanent connection is an adhesively bonded connection between connecting areas of said strap.

14. The closing device of claim 1, wherein said permanent connection is a mechanical connection between connecting areas of said strap.

15. The closing device of claim 1, wherein the length of said inner portion is selected so that it projects in its severed and folded out state beyond an end of said strap.

16. The closing device of claim 1, wherein said permanent connection is located at one end of said strap.

17. The closing device of claim 1, wherein said inner portion is of an elongate design and is coupled to said outer portion through a plurality of webs.

18. The closing device of claim 1, wherein at a severed and folded out state of the inner portion said outer portion of said strap comprises an opening.

19. The closing device of claim 1, wherein said strap is designed symmetrically relative to a line of symmetry extending transversely relative to its longitudinal direction.

20. The closing device of claim 1, wherein said permanent connection is a non-releasable connection.

* * * * *

UNITED STATES PATENT AND TRADEMARK OFFICE

CERTIFICATE OF CORRECTION

PATENT NO. : 6,513,202 B2
DATED : February 4, 2003
INVENTOR(S) : Arnold Zimmermann It is certified that error appears in the above-identified patent and that said Letters Patent is hereby corrected as shown below:

Title page,
Item [73], Assignee:, replace “Nuremberg” with -- Neuenburg --

Signed and Sealed this

First Day of July, 2003

JAMES E. ROGAN
*Director of the United States Patent and Trademark Office*